US007280637B1

(12) United States Patent
Chen et al.

(10) Patent No.: US 7,280,637 B1
(45) Date of Patent: Oct. 9, 2007

(54) SYSTEMS, APPARATUS AND METHODS FOR X-RAY IMAGING

(76) Inventors: Jizhong Chen, 4855 W. Electric Ave., EA-36, Milwaukee, WI (US) 53219; Sergio Lemaitre, 4715 N. Woodruff Ave., Whitefish Bay, WI (US) 53211; Brian Douglas Lounsberry, 750 Grand Ave., Thiensville, WI (US) 53092

( * ) Notice: Subject to any disclaimer, the term of this patent is extended or adjusted under 35 U.S.C. 154(b) by 0 days.

(21) Appl. No.: 11/391,152

(22) Filed: Mar. 28, 2006

(51) Int. Cl.
*H01J 35/06* (2006.01)

(52) U.S. Cl. ..... 378/136; 378/138

(58) Field of Classification Search ..... 378/136–138; 313/302
See application file for complete search history.

(56) References Cited

U.S. PATENT DOCUMENTS 5,623,530 A * 4/1997 Lu et al. ..... 378/136
6,333,969 B1 * 12/2001 Kujirai ..... 378/138

* cited by examiner

*Primary Examiner*—Courtney Thomas
(74) *Attorney, Agent, or Firm*—Carl Horton; Peter Vogel; Michael Smith

(57) ABSTRACT

A cathode cup is provided. The cathode cup includes one or more pockets; and one or more filaments associated with the one or more pockets. A same number of pockets as filaments are present. Each pocket is associated with exactly one filament and is configured to have a length that is tailored to a length of the filament. The cathode cup can be used in an X-ray system having an anode and a cathode. A method of electron beam shaping is provided. The method includes the following steps. A computer-simulated model of a cathode cup is created. The model is used to predict focal spot dimensions. The predicted focal spot dimensions are compared to desired focal spot dimensions. The steps of creating, using and comparing are repeated until the predicted focal spot dimensions match the desired focal spot dimensions. A cathode cup is created based on the computer-simulated model.

20 Claims, 6 Drawing Sheets

SYSTEMS, APPARATUS AND METHODS FOR X-RAY IMAGING

FIELD OF THE INVENTION

This invention relates generally to X-ray imaging, and more particularly to cathode cup designs for enhancing X-ray image quality.

BACKGROUND OF THE INVENTION

X-ray systems are a commonly used medical imaging tool. X-ray systems include an X-ray tube having a cathode that acts as a negative electrode, and an anode, that acts as a positive electrode. The cathode and anode function in generating an X-ray beam that is used for imaging. Specifically, the cathode contains one or more filaments that, when subject to high voltage, release electrons via thermionic emission in the form of an electron beam. The number of filaments employed depends on the particular cathode design. The filaments are typically inset in channels of a cup structure that is part of the cathode, i.e., a cathode cup, that serves to focus the electron beam towards the anode. A portion of the electron beam impacting the anode is refracted off as an X-ray beam.

The size of the focal spot produced when the X-ray beam contacts an imaging surface is indicative of the resolution of the X-ray tube. Namely, the smaller the focal spot size produced, the better the resolution. Increasing the resolution of the X-ray tube is desirable, as it enhances the quality of the images produced.

The focal spot size is measured as two dimensions, focal spot width and focal spot length. Both the focal spot width and the focal spot length can be changed by adjustments being made to the cathode. For example, the focal spot width can be changed by altering the widths of the channels in the cathode cup surrounding the filaments and/or by adjusting the depths at which the filaments are positioned within the channels, thereby altering the shape of the electron beam leaving the cathode.

The focal spot length can be changed by placing tabs of various dimensions in the channels of the cathode cup towards the ends of the filaments, to similarly alter the shape of the electron beam leaving the cathode. These tabs are added by a technician following production of the cathode cup and assembly of the X-ray tube.

The use of tabs to alter the focal spot length is a common industry practice. However, the correct placement of the tabs in the channels is a very delicate, exact and time-consuming process. Basically, technicians adjust focal spot length using tabs by trial and error. Technicians insert tabs of a certain size at a certain position in the channels and then observe the focal spot produced. Depending on the size of the focal spot produced, the technicians can alter the size and/or positioning of the tabs accordingly. This process is performed until the desired focal spot is produced. Even with the most skilled technicians, there is always some variation from one unit to another. Thus, using the tab adjustment process, inconsistencies in the performance of the X-ray tubes are inevitable.

To avoid the time and inconsistencies inherent with the use of tabs to adjust focal spot length, designers hope to eliminate tabs as part of their cathode designs. However, the problem then arises as to how to adjust focal spot length without using tabs. Therefore, techniques are needed to adjust focal spot length without using tabs.

Additionally, with conventional cathode cup designs, a certain amount of focal spot distortion is present. This distortion results in distortions in the images produced. While a certain amount of focal spot distortion is considered, by industry standards, to be acceptable (and expected), increasing demands for higher resolution images require that acceptable level to be constantly reduced. Therefore, techniques for improving image quality are needed.

For the reasons stated above, and for other reasons stated below which will become apparent to those skilled in the art upon reading and understanding the present specification, there is a need in the art for improved X-ray tube design.

BRIEF DESCRIPTION OF THE INVENTION

A cathode cup is provided. The cathode cup includes one or more pockets; and one or more filaments associated with the one or more pockets. A same number of pockets as filaments are present. Each pocket is associated with exactly one filament and is configured to have a length that is tailored to a length of the filament.

An X-ray system is provided. The X-ray system includes an anode; and a cathode. The cathode has a cathode cup having one or more pockets; and one or more filaments associated with the one or more pockets. A same number of pockets as filaments are present. Each pocket is associated with exactly one filament and is configured to have a length that is tailored to a length of the filament.

A method of electron beam shaping is provided. The method includes the following steps. A computer-simulated model of a cathode cup is created. The model is used to predict focal spot dimensions. The predicted focal spot dimensions are compared to desired focal spot dimensions. The steps of creating, using and comparing are repeated until the predicted focal spot dimensions match the desired focal spot dimensions. A cathode cup is created based on the computer-simulated model.

Apparatus, systems, and methods of varying scope are described herein. In addition to the aspects and advantages described in this summary, further aspects and advantages will become apparent by reference to the drawings and by reading the detailed description that follows.

DETAILED DESCRIPTION OF THE INVENTION

Accordingly, a cathode cup 402 is provided having a dual pocket design wherein a pocket is provided for each of the small filament and the large filament. Each pocket has a length that is tailored to a length of the filament therein. As such, the length of the focal spot produced by each filament can be adjusted by adjustments made to the length of the pockets, thus eliminating the need for tabs. Further, these adjustments to the pockets can be made during production of cathode cup 402, enhancing consistency. Also, a curved portion is included in the design of the pockets to accommodate for focal spot bending during imaging. As such, focal spot distortion is minimized, or eliminated.

Thus, the needs for tab-less focal spot length adjustment and for improved image quality are solved.

The detailed description is divided into four sections. In the first section, a conventional X-ray system and associated apparatus are described. In the second section, improved X-ray apparatus are described. In the third section, methods of producing the apparatus are described. Finally, in the fourth section, a conclusion of the detailed description is provided.

Conventional X-Ray System and Apparatus

Figure 1:
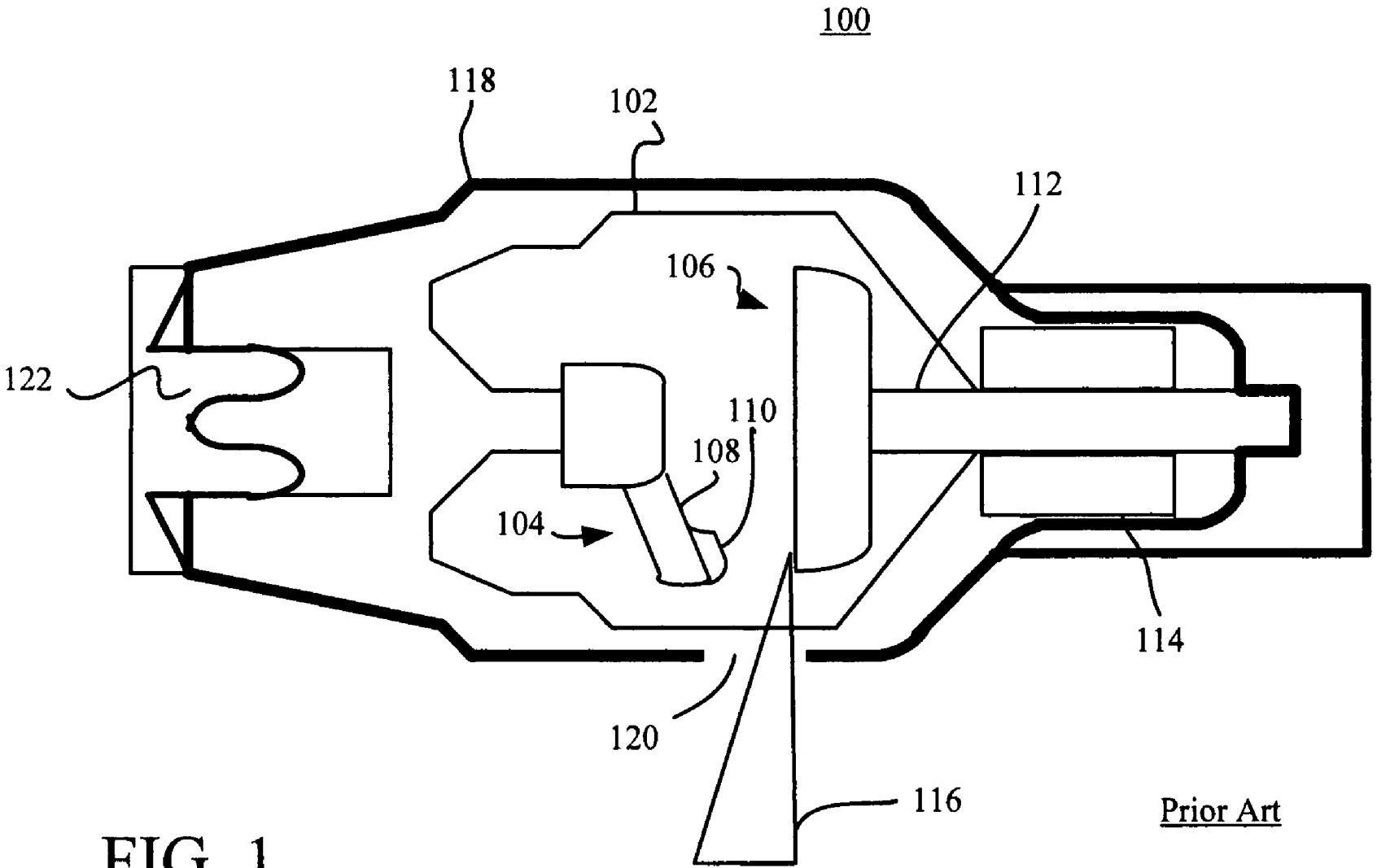
Prior Art FIG. 1
FIG. 1 is a cross-sectional diagram of a conventional X-ray tube.

FIG. 1 is a cross-sectional diagram of conventional X-ray tube 100. X-ray tube 100 includes X-ray tube insert 102 having cathode 104 and anode 106. Cathode 104 acts as a negative electrode for X-ray tube 100. Cathode 104 has one or more filaments (not shown) positioned on the end of cathode arm 108.

The number of filaments employed depends on the X-ray tube design. For example, dual focus X-ray tubes have two filaments, one small filament and one large filament. The small filament produces a small focal spot and is used for fine focus applications. The large filament produces a broad focal spot and is used when fast exposures are needed. Either the large filament or the small filament can be chosen by a user depending on the desired imaging application. The focal spot produced by the large filament will hereinafter be referred to as "the large focal spot" and the focal spot produced by the small filament will hereinafter be referred to as "the small focal spot."

The filaments, when subject to high voltage, release electrons in the form of an electron beam. A portion of the electron beam released by the filaments is refracted off of anode 106 as X-ray beam 116.

The filaments are inset in cathode cup 110. Cathode cup 110 serves to focus the electron beam towards the anode. A cathode cup and associated filaments are shown, for example, in FIG. 2, and are described below.

Anode 106 is mounted on anode rotor 112. Stator 114 surrounds a portion of anode rotor 112. An anode having a rotor and a stator is well known to those of skill in the art and is not further described herein.

X-ray tube insert 102 is surrounded by housing 118. Housing 118 is typically made up of a metal such as aluminum, lead or a combination thereof. Housing 118 has port window 120 therein. Port window 120 allows X-ray beam 116 to pass through housing 118.

X-ray tube 100 further includes bellow 122. The inclusion of a bellow 122 in an X-ray tube 100 is well known to those of skill in the art and is not described further herein.

Figure 2:
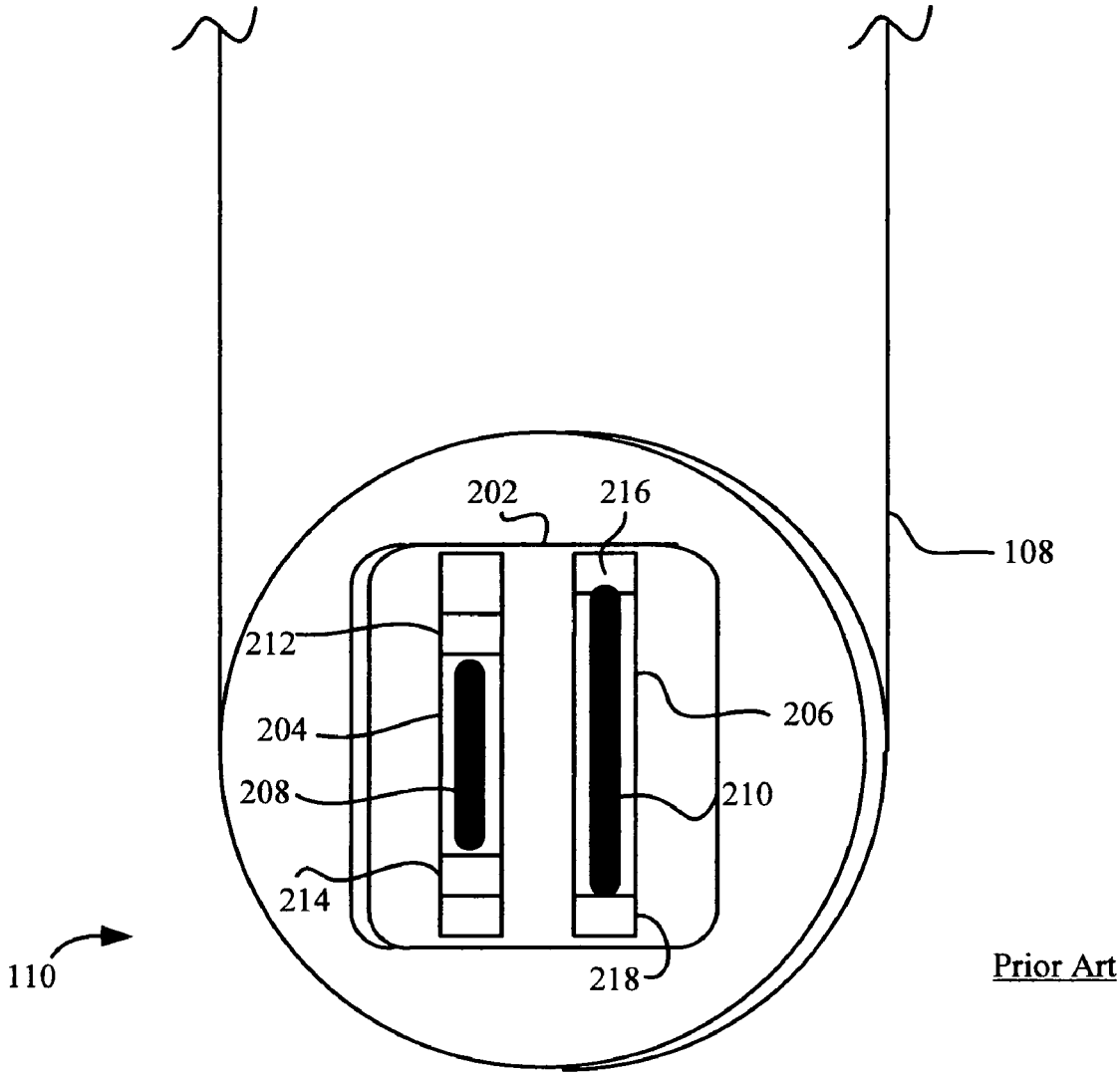
FIG. 2 is a diagram of a conventional cathode cup.

FIG. 2 is a diagram of conventional cathode cup 110. As shown in FIG. 1, and as described above, cathode cup 110 is positioned on the end of cathode arm 108. Cathode cup 110 has pocket 202 recessed therein. Within pocket 202 there are two channels, channel 204 and channel 206. Set within channels 204 and 206 are filaments 208 and 210, respectively.

Filament 208 is smaller in length than filament 210. Therefore, filament 208 and filament 210 are hereinafter referred to as the "small filament" and the "large filament," respectively. Each filament is made of a suitable filament material, including, but not limited to, tungsten or an alloy thereof. For ease of depiction, filament 208 and filament 210 are shown as solid lines. However, one of skill in the art would recognize that X-ray filaments are typically configured as coils.

During operation of X-ray tube 100, either of filament 208 and filament 210 can be chosen for imaging. As described above, the small filament produces a small focal spot and is used for fine focus applications. The large filament produces a broad focal spot, as described above, and is used when fast exposures are needed.

If the small filament is chosen for imaging, the focal spot produced by the small filament is hereinafter referred to as the "small focal spot." If, on the other hand, the large filament is chosen for imaging, the focal spot produced is hereinafter referred to as the "large focal spot."

Prior to using conventional cathode cup 110 for imaging, the sizes of the large and/or of the small focal spots need to be adjusted for proper imaging contrast and quality. Specifically, one or more of the large focal spot length and width and/or the small focal spot length and width need to be adjusted.

Adjustment of both the large and small focal spot lengths is achieved using tabs, e.g., tabs 212, 214, 216 and 218, placed in channel 204 and channel 206, near the ends of the respective filaments. The basic function of the tabs is to reduce the length of channel 204 and/or channel 206 and thereby block a portion of the length of the electron beam produced by the respective filaments, so as to attain a beam of a desirable length. The placement and/or dimensions of tabs 212, 214, 216 and 218 can be varied until the desired image quality is produced. The use and placement of tabs in a cathode cup is known to those of skill in the art and is not described further herein. As mentioned above, the use of tabs can be disadvantageous, as it is very tedious to achieve their correct placement, and since the tabs are placed by a technician, variation from one cathode cup to another is inevitable.

Adjustment of both the large and small focal spot widths is achieved by varying the width of the channels and/or by varying the depth that the filaments are set into their respective channels. For example, the deeper a filament is set into a channel, the narrower the width of the focal spot. The adjustment of focal spot width using channel width and/or filament depth is known to those of skill in the art and is not described further herein.

Figure 3:
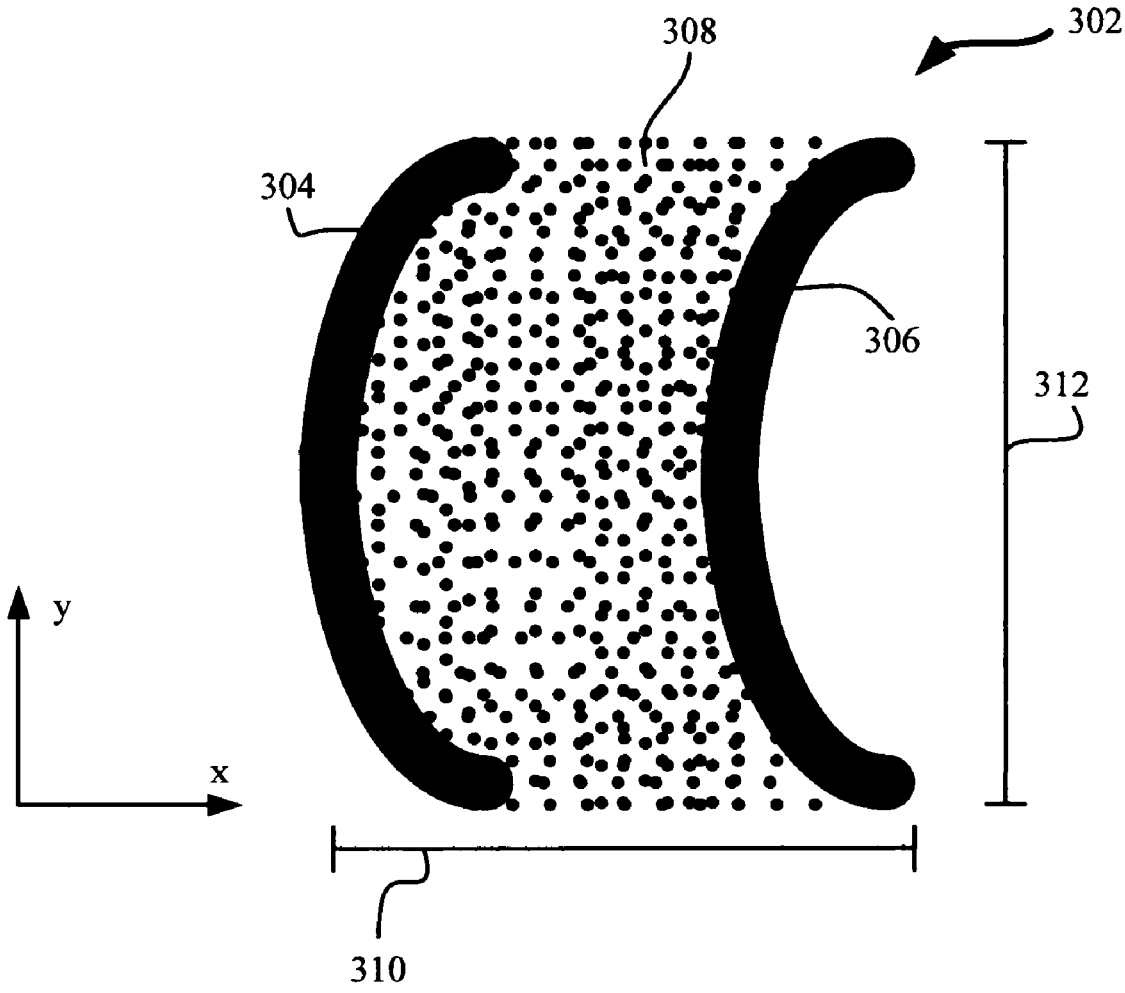
FIG. 3 is a diagram illustrating a large focal spot produced by an X-ray tube having a conventional cathode cup.

Conventional cathode cup designs, such as cathode cup 110, produce both large and small focal spots that have a level of distortion present in them. This distortion is due, at least in part, to a side effect of electrical field distribution at the corners of the pocket, e.g., pocket 202. The distortion is most prevalent in the large focal spot. For example, FIG. 3 is a diagram illustrating large focal spot 302 which is representative of a focal spot that can be produced by conventional cathode cup 110. The large focal spot 302 has two peaks, e.g., peak 304 and peak 306, with shadow area 308 therebetween.

The large focal spot length 312, as depicted in FIG. 3, is the dimension of large focal spot 302 along the Y-axis. The large focal spot width 310, as depicted in FIG. 3, is the dimension of large focal spot 302 along the X-axis.

As is shown in FIG. 3, there is a considerable amount of distortion of large focal spot 302. Namely, there is pronounced bending of focal spot 302, e.g., along its length. An ideal shape for the large focal spot would be two straight, vertical peaks with a straight vertical shadow area therebetween. Instead, peaks 304 and 306 along with shadow area 308 curve out in the X-axial direction both at the top and at the bottom of large focal spot 302. The larger the amount of distortion, the poorer the quality of the images produced.

Apparatus Embodiments

Figure 4:
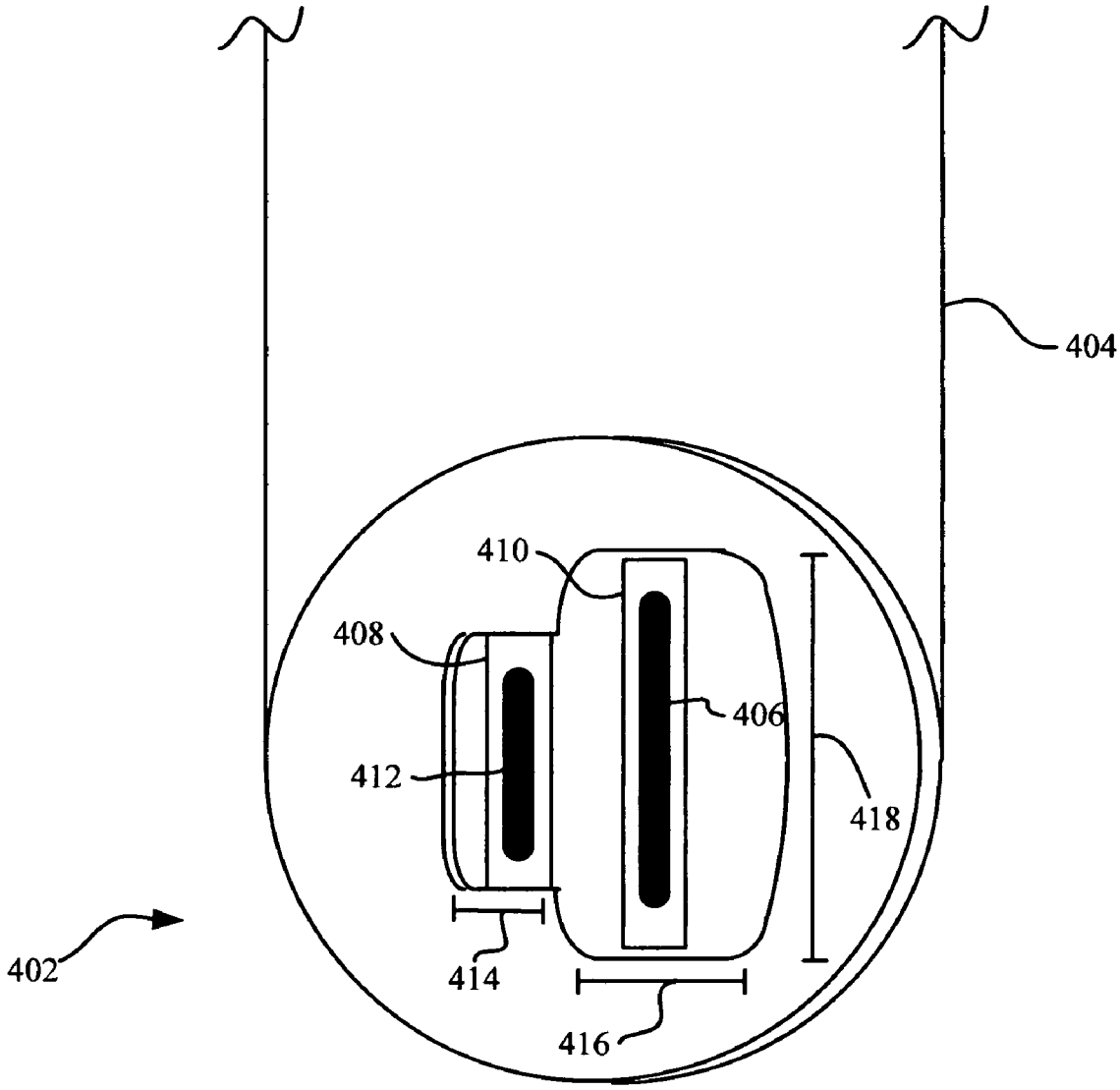
FIG. 4 is a diagram of an illustrative cathode cup.

FIG. 4 is a diagram of illustrative cathode cup 402. Cathode cup 402 is positioned on the end of cathode arm 404. Cathode cup 402 has two pockets, e.g., pockets 414 and 416, recessed therein. Within pocket 414 is channel 408. Within pocket 416 is channel 410. Set within channel 408 is filament 412 and set within channel 410 is filament 406.

As described above, the number of filaments employed depends on the X-ray tube design. While the present description is directed to a dual focus X-ray tube, e.g., having two filaments, it is to be understood that the instant teachings are broadly applicable to single filament designs, as well as, multi-filament designs having more than two filaments;

Filament 412 is smaller in length than filament 406. Therefore, as above, filament 412 and filament 406 are hereinafter referred to as the "small filament" and the "large filament," respectively. Each of filaments 412 and 406 is made of a suitable filament material, including, but not limited to, tungsten or an alloy thereof. For ease of depiction, filament 412 and filament 406 are shown as solid lines. However, one of skill in the art would recognize that X-ray filaments are typically configured as coils. Further, as above, the focal spot produced by the small filament is referred to as the "small focal spot," and the focal spot produced by the large filament is referred to as the "large focal spot."

In contrast to conventional cathode cup 110 which has a single pocket, e.g., pocket 202, a unique feature of cathode cup 402 is that cathode cup 402 has a dual pocket design, wherein a pocket is provided for each filament, the pocket having a length that is tailored to the length of the filament. Specifically, cathode cup 402 has pockets 414 and 416. Pocket 414 is associated with filament 412, the small filament. Pocket 416 is associated with filament 406, the large filament. Accordingly, pocket 414 has a length that is tailored to the length of filament 412 and pocket 416 has a length that is tailored to the length of filament 406. As such, pocket 414 has a length that is smaller than a length of pocket 416.

A particular pocket length is required to achieve a proper small focal spot length, and a different particular pocket length is required to achieve a proper large focal spot length. Specifically, there is a particular length that pocket 414 should be in order to block a portion of the length of the electron beam produced by the small filament so as to attain a small focal spot of desirable length. Similarly, there is a particular length that pocket 416 should be in order to block a portion of the length of the electron beam produced by the large filament so as to attain a large focal spot of desirable length. Techniques will be described below that allow researchers to predict the lengths of both the large and the small focal spots that will be produced by a particular cathode cup design having pockets of various lengths. Thus, given a desired focal spot length (large or small) and the capability of predicting the length of pocket that will produce that desired focal spot length, researchers can design cathode cups having the proper length pockets.

Cathode cup 402 having a dual pocket design can be manufactured using standard production methods commonly employed to create cathode cups. For example, standard electrical discharge machining (EDM) techniques, including wire EDM manufacturing techniques, can be employed to produce cathode cup 402 having a dual pocket.

Another unique feature of cathode cup 402 is that cathode cup 402 is configured to compensate for at least a portion of focal spot bending that occurs during imaging. Specifically, pocket 416 has curved portion 418 that extends along the length of pocket 416 adjacent to a side of filament 406 opposite filament 412. This curved configuration of pocket 416 is shown in FIG. 4. Incorporating curved portion 418 into pocket 416 helps to minimize, or eliminate, bending commonly encountered in the large focal spot. See above description.

Curved portion 418 of pocket 416 is configured to have a constant, or near constant, radius of curvature along its entire length. According to an illustrative embodiment, curved portion 418 is configured to have a radius of curvature of up to about 50 millimeters, e.g., a radius of curvature of about 40 millimeters, along its entire length. Any other various curvature radii that compensate for at least a portion of focal spot bending that occurs during imaging, can also be similarly employed.

Figure 5:
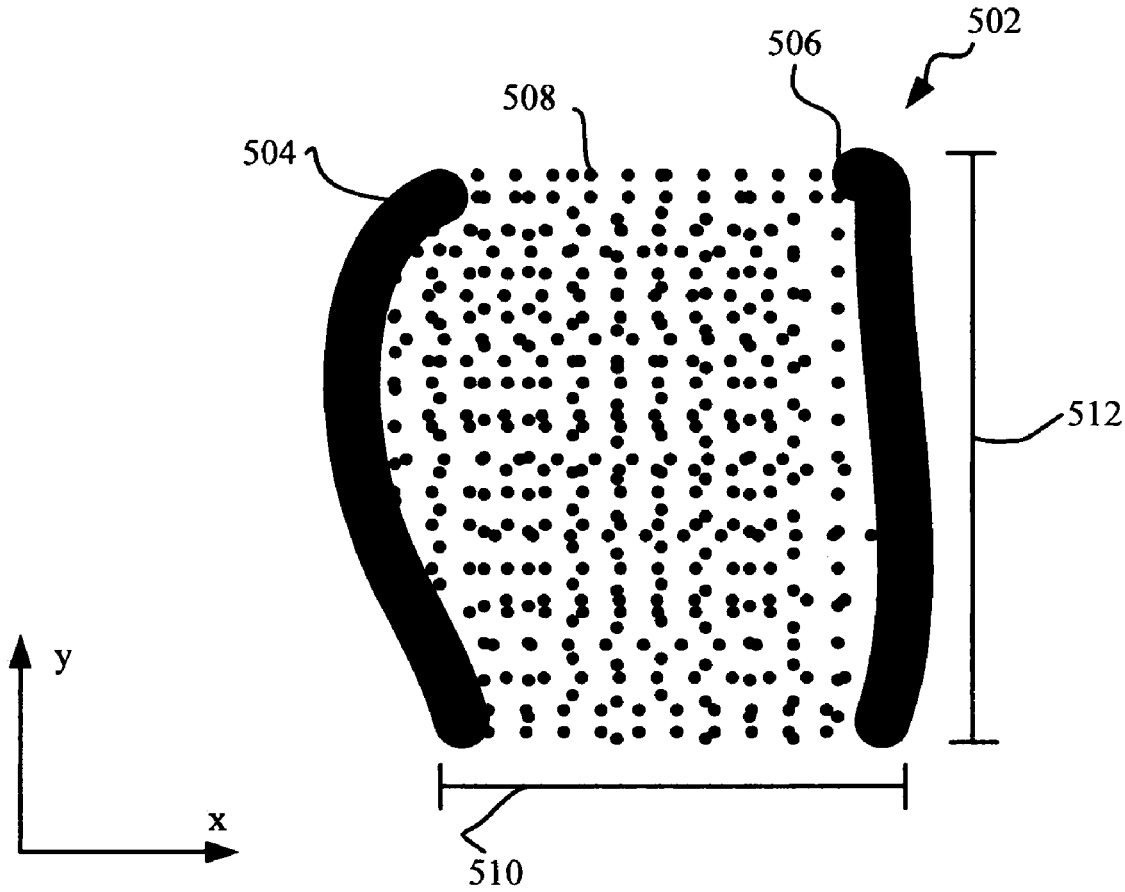
FIG. 5 is a diagram illustrating a large focal spot produced using the cathode cup of FIG. 4.

As is shown in FIG. 5 and as is described in detail below, curved portion 418 minimizes distortion, due to focal spot bending, along the large focal length. While the instant description details a curved portion being present only on the large filament side, it is to be understood that a similar curved portion can also be implemented in a corresponding location on the small filament side, to help minimize, or eliminate any bending along the small focal spot length. Bending along the small focal spot length, however, is typically minimal. As such, the instant description is directed to compensating for focal spot distortion along only the large focal spot length.

As described above, the distortion present in conventional cathode cup designs is due to a side effect of electrical field distribution at the corners of the pocket, e.g., pocket 202 in conventional cathode cup 110. More specifically, the distortion is caused by the weak electrical focusing forces in the width direction at the corners of the pocket, that is, by the stronger electrical focusing force in the width direction at the central portion of the channel, e.g., channel 206. The introduction of curved portion 418, e.g., in cathode cup 402, decreases the electrical focusing force of the central portion of the channel and makes the focusing force along, e.g., channel 410, more uniform in the width direction, which leads to a better focal spot image quality. Further, only three-dimensional modeling techniques, such as those that are described below, which accommodate electron optics, can be used to simulate the distortion of the focal spots.

FIG. 5 is a diagram illustrating large focal spot 502, which is representative of a large focal spot that can be produced using cathode cup 402. Large focal spot 502 has peak 504 and peak 506, and shadow area 508 extending therebetween.

The large focal spot length 512, as depicted in FIG. 5, is the dimension of large focal spot 502 extending along the y-axis. The large focal spot width 510, as depicted in FIG. 5 is the dimension of large focal spot 502 extending along the X-axis. As shown in FIG. 5, only minimal amounts of bending are present in peak 506, e.g., peak 506 is substantially a straight, vertical peak. This is due, at least in part, to curved portion 418 being present in pocket 416 of cathode cup 402. The reduced bending in peak 506 will result in less distortion and greater image quality.

Method Embodiments

Figure 6:
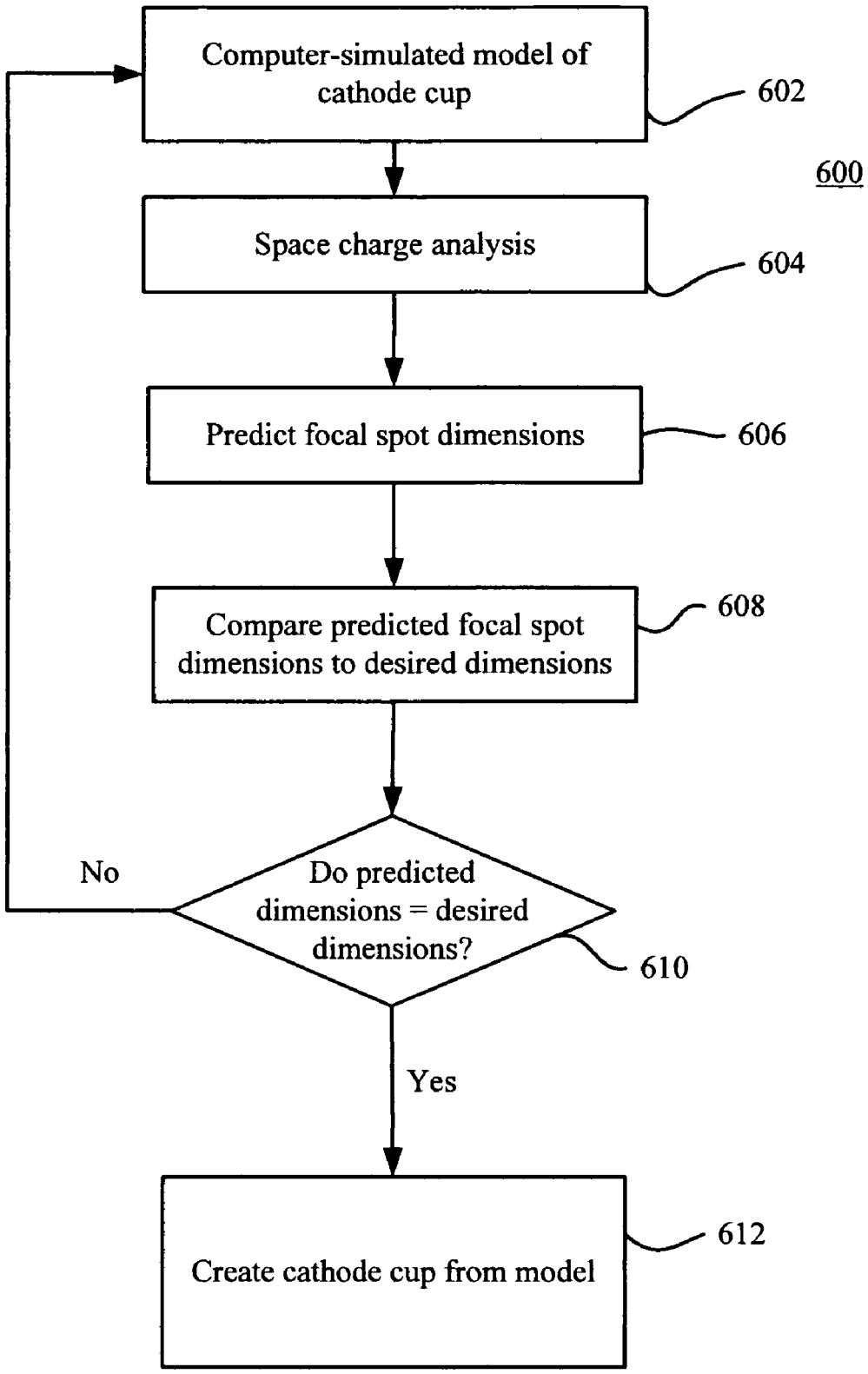
FIG. 6 is a diagram of an illustrative electron beam shaping methodology.

FIG. 6 is a diagram illustrating exemplary electron beam shaping methodology 600. As described above, in order to implement beam-shaping technology into the cathode cup design during production of the cathode cup, techniques are needed to accurately predict the dimensions of the focal spot that will be produced by any given design. Thus, in step 602, a computer-simulated model of a cathode cup is created. The model is produced having the beam shaping design features described herein. For example, the cathode cup model will have a dual pocket design with the length of each pocket tailored to the length of the filament contained therein. Also, the cathode cup model will have a curved portion adjacent to a side of the large filament opposite the small filament.

According to an exemplary embodiment, the computer-simulated model is produced using a modeling and designing program, such as OPERA-3d. OPERA-3d, by Vector Fields, a Cobham Group Company, Dorset, U.K., provides an environment that includes facilities for fast and accurate application analysis, including three-dimensional geometric modeling and post-processing capabilities. OPERA-3d is a finite element environment for the complete analysis and design of electromagnetic applications in three dimensions. OPERA-3d has been developed over three decades and has a highly successful track record for modeling and designing of a very wide range of applications, especially for electron optics design;

Having a three-dimensional model to work with is an important feature of the cathode cup design. Namely, conventional design models worked in two-dimensions and thus were limited to addressing only individual parameters. For example, some traditional cathode cup modeling allowed designers to review only the parameter of focal spot width. Studying focal spot width without consideration for the focal spot length, cannot provide the full picture that designers need. Thus, for example, using the traditional methods, designers could address focal spot width using modeling, and then make post-production modifications, e.g., using tabs, to address focal spot length. This technique is, however, inefficient. With a three-dimensional model that allows designers to look at both the focal spot width and the focal spot length parameters together, permits researchers to design a cathode cup that does not require any post-production modification.

In step 604, once a three-dimensional computer-simulated model of the cathode cup is created, a space charge analysis is performed on the cathode cup design. The space charge analysis is a computer-based analysis that can be performed using the SCALA program which is a specialist finite element module in OPERA-3d for the analysis of the electromagnetic fields coupled with the space charge effects on high current (charged particle) beams.

SCALA computes the effects of space charge on beams of charged particles in electrostatic fields in three dimensions. The space charge analysis allows designers to accurately map the path of the electron beams produced by the filaments in the charged environment between the cathode and the anode.

In step 606, from the space charge analysis, focal spot prediction can be made. Namely, the focal spot dimensions, e.g., focal spot width and focal spot length, can be predicted for the X-ray beam produced using the modeled cathode cup. The focal spot predictions can be achieved using a computer-based application, such as MATLAB. MATLAB, by The MathWorks, Inc., Natick, Mass., with its many tool boxes is a novel programming environment especially good for mathematical computation, analysis, visualization, and algorithm development. MATLAB is a high-level interpreted programming language suited to calculations involving vectors and matrices. MATLAB can accurately predict the trajectories of the electron beam particles off of the anode surface and onto the imaging surface.

In step 608, a comparison can then be made between the predicted focal spot dimensions and desired focal spot dimensions. According to an illustrative embodiment, a desired large focal spot length is between about one millimeter and about 1.3 millimeters, for example about 1.18 millimeters, and a desired large focal spot width is between about one millimeter and about 1.3 millimeters, for example about 1.2 millimeters. A desired small focal spot length is between about 0.5 millimeters and about one millimeter, for example about 0.68 millimeter, and a small focal spot width is between about 0.5 millimeters and about one millimeter, for example, about 0.84 millimeters. In step 610, based on this comparison, if any of the focal spot dimensions need to be altered, e.g., the predicted focal spot dimensions are not within the tolerances of the desired focal spot dimensions, the computer-simulated model can be altered and the space charge analysis and focal spot predictions can be performed repeatedly until the computer-simulated model results in predicted focal spot dimensions that match the desired focal spot dimensions.

The tolerances of the predicted focal spot dimensions are determined by the current machining tolerances on the model created. By way of example only, the predicted focal spot dimensions can be targeted to the mean values of X-ray tubes currently in production. The computer-simulated, three-dimensional model can be used to predict the impacts of the manufacturing tolerances, including, but not limited to, filament distortion, filament set-height tolerance, machining tolerances, anode-cathode spacing and filament temperature distribution.

In step 612, once the predicted focal spot dimensions match the desired focal spot dimensions, the cathode cup can be machined based on the computer-simulated model that generated the correct predicted focal spot dimensions. As described above, machining can be carried out using, e.g., wire EDM techniques.

CONCLUSION

Systems, apparatus and methods for x-ray imaging have been described. Although specific embodiments are illustrated and described herein, any arrangement which is calculated to achieve the same purpose may be substituted for the specific embodiments shown. This application is intended to cover any adaptations or variations. In particular, the names of the systems apparatus and methods are not intended to limit embodiments. Furthermore, additional methods and apparatus can be added to the components, functions can be rearranged among the components, and new components to correspond to future enhancements and physical devices used in embodiments can be introduced without departing from the scope of embodiments. Embodiments are applicable to future imaging systems and different imaging devices.

We claim:

1. A cathode cup comprising:

at least one pocket;

at least one filament associated with the at least one pocket, wherein a same number of pockets as filaments are present, with each pocket being associated with exactly one filament and having a length that is tailored to a length of the filament, and a singular hole having irregular rectangular proportions, wherein the at least one pocket and the at least one filament are positioned within the singular hole, wherein the cathode cup does not comprise a tab.

2. The cathode cup of claim 1, wherein the least one pocket further comprise a first pocket and a second pocket, the first pocket having a length that is greater than a length of the second pocket, and wherein the at least one filament further comprise a large filament and a small filament, the large filament being associated with the first pocket and the small filament being associated with the second pocket.

3. The cathode cup of claim 1, further comprising a channel within each of the pockets into which the at least one filament are set.

4. The cathode cup of claim 1, wherein at least one of the at least one pocket are configured to compensate for at least a portion of electron beam bending.

5. The cathode cup of claim 1, wherein at least one of the at least one pocket has a curved portion configured to compensate for at least a portion of electron beam bending.

6. The cathode cup of claim 5, wherein the curved portion has a radius of curvature of about 40 millimeters.

7. The cathode cup of claim 5, wherein the curved portion extends along a length of at least one of the at least one pocket adjacent to at least one of the at least one filament.

8. The cathode cup of claim 5, wherein the least one pocket further comprises a first pocket and a second pocket, the first pocket having a length that is greater than a length of the second pocket, and wherein the at least one filament further comprises a large filament and a small filament, the large filament being associated with the first pocket and the small filament being associated with the second pocket; and wherein the curved portion extends along a length of the first pocket adjacent to a side of the large filament opposite the small filament.

9. An X-ray system comprising:

an anode; and a cathode, the cathode having a cathode cup comprising:

least one pocket;

at least one filament associated with the least one pocket, wherein a same number of pockets as filaments are present, with each pocket being associated with exactly one filament and configured to have a length that is tailored to a length of the filament, and a singular hole having irregular rectangular proportions, wherein the at least one pocket and the at least one filament are positioned within the singular hole, wherein the cathode cup does not comprise a tab.

10. The system of claim 9, wherein the least one pocket comprise a first pocket and a second pocket, the first pocket having a length that is greater than a length of the second pocket, and wherein the at least one filament further comprises a large filament and a small filament, the large filament being associated with the first pocket and the small filament being associated with the second pocket.

11. The system of claim 9, wherein at least one of the pockets has a curved portion configured to compensate for at least a portion of electron beam bending.

12. The system of claim 11, wherein the curved portion extends along a length of at least one of the at least one pocket adjacent to the at least one filament.

13. A method of electron beam shaping, the method comprising the steps of:

creating a computer-simulated model of a cathode cup;

using the model to predict focal spot dimensions;

comparing the predicted focal spot dimensions to desired focal spot dimensions;

repeating the creating, using and comparing steps until the predicted focal spot dimensions match the desired focal spot dimensions; and creating a cathode cup based on the computer-simulated model.

14. The method of claim 13, wherein the predicted focal spot dimensions include both focal spot width and focal spot length.

15. The method of claim 13, wherein the cathode cup is created using electrical discharge machining techniques.

16. The method of claim 13, wherein the computer-simulated cathode cup model further comprises:

least one pocket; and at least one filament associated with the at least one of the at least one pocket, wherein a same number of pockets as filaments are present, with each pocket being associated with exactly one filament and configured to have a length that is tailored to a length of the filament.

17. The method of claim 16, wherein at least one of the pockets has a curved portion configured to compensate for at least a portion of electron beam bending.

18. The method of claim 17, wherein the curved portion extends along a length of at least one of the at least one pocket adjacent to at least one of the at least one filament.

19. The method of claim 13, wherein the desired focal spot dimensions further comprise a large focal spot length of between about one millimeter and about 1.3 millimeters; and a large focal spot width of between about one millimeter and about 1.3 millimeters.

20. The method of claim 13, wherein the desired focal spot dimensions further comprise a small focal spot length of between about 0.5 millimeters and about one millimeter; and a small focal spot width of between about 0.5 millimeters and about one millimeter.

* * * * *